US007496180B1

(12) United States Patent
Subraya et al.

(10) Patent No.: US 7,496,180 B1
(45) Date of Patent: Feb. 24, 2009

(54) FOCAL SPOT TEMPERATURE REDUCTION USING THREE-POINT DEFLECTION

(75) Inventors: Madhusudhana T. Subraya, New Berlin, WI (US); Ron Kent Hockersmith, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/846,563

(22) Filed: Aug. 29, 2007

(51) Int. Cl.
*H01J 35/30* (2006.01)

(52) U.S. Cl. ..... 378/137; 378/138

(58) Field of Classification Search ..... 378/137–138, 378/141, 119, 113
See application file for complete search history.

(56) References Cited

U.S. PATENT DOCUMENTS 6,181,771 B1 * 1/2001 Hell et al. ..... 378/137
6,778,633 B1 * 8/2004 Loxley et al. ..... 378/113
6,968,039 B2 11/2005 Lemaitre et al.
2006/0115050 A1 * 6/2006 Resnick ..... 378/108

* cited by examiner

*Primary Examiner*—Hoon Song
(74) *Attorney, Agent, or Firm*—Ziolkowski Patent Solutions Group, SC

(57) ABSTRACT

An x-ray tube includes an anode comprising a focal track and a cathode assembly configured to emit an electron beam toward a focal spot on the focal track. The x-ray tube also includes a controller configured to wobble the electron beam among a plurality of focal points in a direction tangent to the focal track. The plurality of focal points includes at least one focal point that is bounded by a pair of boundary focal points. The controller is further configured to delay a wobble of the electron beam away from the at least one focal point for a pre-determined amount of time.

23 Claims, 4 Drawing Sheets

FOCAL SPOT TEMPERATURE REDUCTION USING THREE-POINT DEFLECTION

BACKGROUND OF THE INVENTION

The present invention relates generally to x-ray imaging systems. More particularly, the present invention relates to systems and methods of adjusting focal spot positioning relative to a target within an imaging tube.

Traditional x-ray imaging systems include an x-ray source and a detector array. X-rays are generated by the x-ray source, pass through an object, and are detected by the detector array. Electrical signals generated by the detector array are conditioned to reconstruct an x-ray image of the object.

In computed tomography (CT) imaging systems, the x-ray source emits a fan-shaped beam toward a subject or object, such as a patient or a piece of luggage. Hereinafter, the terms "subject" and "object" shall include anything capable of being imaged. The beam, after being attenuated by the subject, impinges upon an array of radiation detectors. The intensity of the attenuated beam radiation received at the detector array is typically dependent upon the attenuation of the x-ray beam by the subject. Each detector element of the detector array produces a separate electrical signal indicative of the attenuated beam received by each detector element. The electrical signals are transmitted to a data processing system for analysis which ultimately produces an image.

Generally, the x-ray source and the detector array are rotated about the gantry within an imaging plane and around the subject. The x-ray source typically comprises an x-ray tube that emits the x-ray beam at a focal point. In order to generate the x-rays, a large voltage potential of approximately 150 kV is created across a vacuum gap between a cathode and an anode allowing electrons, in the form of an electron beam, to be emitted from the cathode to a target portion of the anode. In the releasing of the electrons, a filament contained within the cathode is heated to incandescence by passing an electric current therein. The electrons are accelerated by the high voltage potential and impinge on the target at a focal spot, whereby they are abruptly slowed down, directed at an impingement angle, $\alpha$, of approximately 90°, to emit x-rays through a CT tube window.

The cathode or electron source is typically a coiled tungsten wire that is heated to temperatures approaching 2600° Celsius. The electrons are accelerated by an electric field imposed between the cathode and the anode. The anode, in a high power x-ray tube designed for current CT devices, is a tungsten target having a target face, that rotates at angular velocities of approximately 120 Hz or greater.

The focal spot has an associated location on a surface of the anode, often referred to as the focal track. The focal spot location is controllably translated within the x-ray imaging tube in order to perform a double sampling technique, which is utilized to improve modulation transfer functions (MTF) in the CT system. Double sampling is accomplished in conventional imaging systems by adjusting focal spot positioning on the target or surface of the anode, electronically without mechanical motion, via use of deflection coils or plates within an x-ray tube. The deflection coils and plates deflect an electron beam by creating either a local magnetic or an electrostatic field.

To perform double sampling, the focal spots are generally wobbled between two positions on the target in the direction tangent to the focal track. While this two-point wobbling can greatly improve image quality and resolution in resulting CT images, it also generates tremendous heat along the focal track of the anode. The buildup of this heat on the focal track generated by the wobbling focal spot can result in temperatures of greater than 3000 degrees Celsius, which can lead to reduction of x-ray tube performance and peak power capability by, for example, focal track melting, high voltage instability in the x-ray tube, or early life radiation output drop-off.

The heat generated at the focal spot is dependent on a number of factors such as the size of the focal spot, the direction of the wobbling, and the transition time and/or deflection distance between the two points. As such, various methods have been employed in the prior art in an attempt to lower these very high focal spot temperatures created by two-point wobbling. In order to combat the negative effects resultant from the high focal spot temperatures, many current designs significantly lower power levels for generating the x-rays. Other designs have attempted to lower the focal spot temperatures at the focal track by increasing the target rotation speed, increasing the focal spot size, increasing the deflection transition time between the two points in the wobble, or reducing the power capability of the x-ray tube.

Therefore, a need exists for reducing focal spot temperatures along a focal track on a target anode, without compromising optimal performance criteria of the x-ray source. That is, it would be desirable to design an apparatus and method for reducing focal spot temperatures on a target anode without the current associated needs to lower power levels for generating the x-rays, to increase the target rotation speed, to increase the focal spot size/spot radius, or to increase the deflection transition time.

BRIEF DESCRIPTION OF THE INVENTION

The present invention overcomes the aforementioned problem by providing a method and apparatus for operating an electromagnetic energy source and providing an electron beam wobble scheme that includes a multi-point focal pattern for forming a focal spot.

In accordance with one aspect of the present invention, an x-ray tube includes, an anode comprising a focal track and a cathode assembly configured to emit an electron beam toward a focal spot on the focal track. The x-ray tube also includes a controller configured to wobble the electron beam among a plurality of focal points in a direction tangent to the focal track, the plurality of focal points comprising at least one focal point bounded by a pair of boundary focal points. The controller is further configured to delay wobble of the electron beam away from the at least one focal point for a predetermined amount of time.

In accordance with another aspect of the present invention, a method for operating an electromagnetic energy source includes the step of emitting an electron beam along a beam path from a cathode and onto a focal spot on a target to cause X-rays to be emitted from the target. The method also includes the step of asymmetrically biasing the electron beam to shift the focal spot on the target within a focal spot range, the step of asymmetrical biasing further including biasing the electron beam onto a first focal point, wherein the first focal point is positioned at a first end of the focal spot range. The step of asymmetrically biasing further includes biasing the electron beam from the first focal point onto a second focal point, wherein the second focal point is positioned between the first focal point and a third focal point positioned at a second end of the focal spot range and wherein the electron beam remains stationary at the second focal point for a specified dwell time. The step of asymmetrically biasing still further includes biasing the electron beam from the second focal point onto the third focal point.

In accordance with yet another aspect of the present invention, an x-ray source includes a vacuum enclosure, a rotatable anode disposed within the vacuum enclosure, and a cathode assembly disposed within the vacuum enclosure that emits an electron beam onto a focal spot of the rotatable anode, the cathode assembly comprising a steering electrode configured to asymmetrically bias the electron beam. The x-ray source also includes a control unit configured to control the steering electrode to deflect the electron beam onto the rotatable anode in a multi-point focal spot pattern within a range of deflection, wherein the multi-point focal spot pattern includes a stationary focal point positioned between ends of the range of deflection and wherein the control unit is further configured to control the steering electrode to maintain deflection of the electron beam at the stationary focal point for a desired time.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
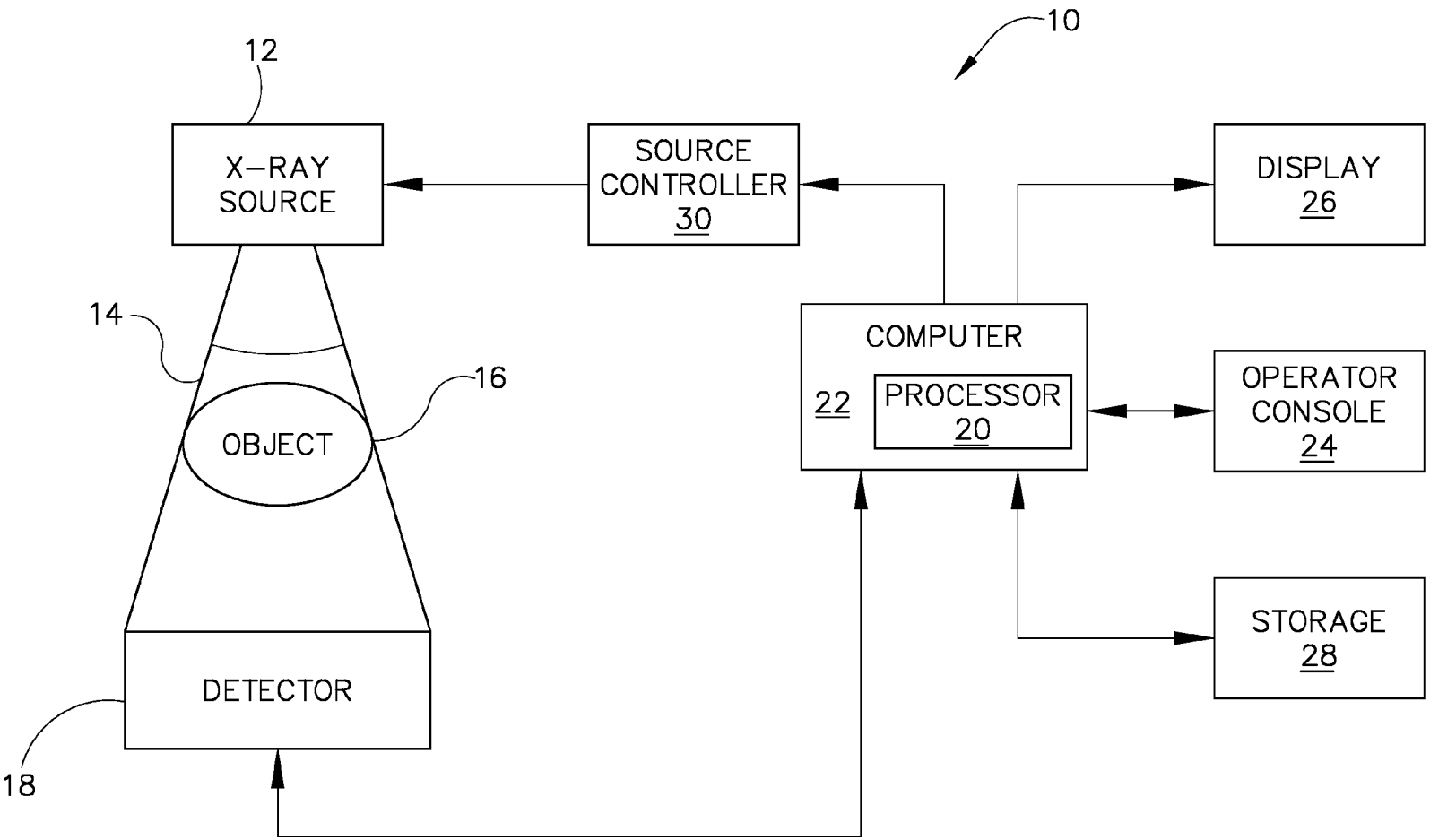
FIG. 1 is a block schematic diagram of an x-ray imaging system.

FIG. 1 is a block diagram of an embodiment of an imaging system 10 designed both to acquire original image data and to process the image data for display and/or analysis in accordance with the present invention. It will be appreciated by those skilled in the art that the present invention is applicable to numerous medical imaging systems implementing an x-ray tube, such as x-ray or mammography systems. Other imaging systems such as computed tomography systems and digital radiography systems, which acquire image three dimensional data for a volume, also benefit from the present invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays pass through object 14 and, after being attenuated by the object, impinge upon a detector array 18. Each detector in detector array 18 produces an analog electrical signal that represents the intensity of an impinging x-ray beam, and hence the attenuated beam, as it passes through the object 16. In one embodiment, detector array 18 is a scintillation based detector, however, it is also envisioned that direct-conversion type detectors (e.g., CZT detectors, etc.) may also be implemented.

A processor 20 receives the analog electrical signals from the detector array 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Figure 2:
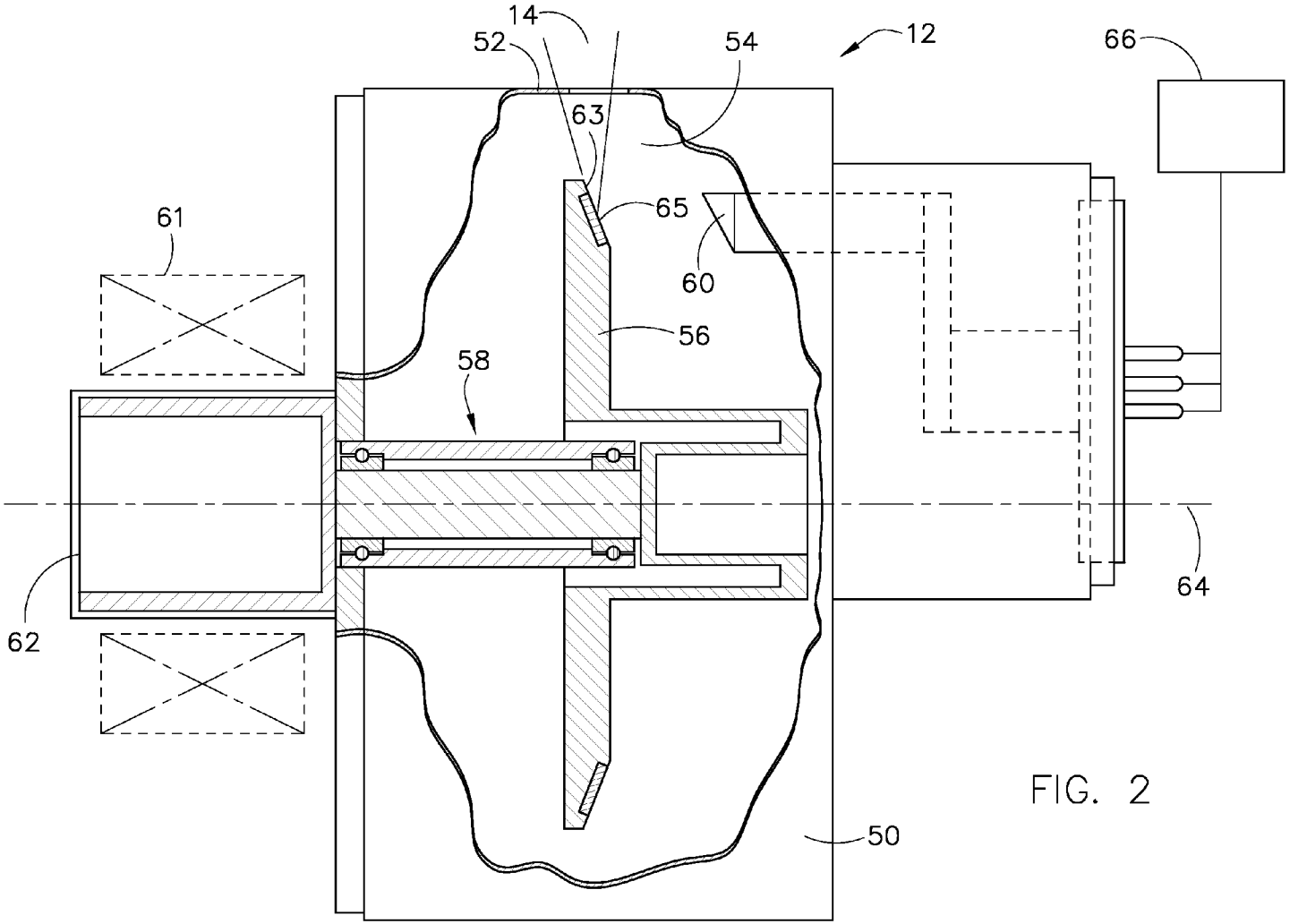
FIG. 2 is a cross-sectional view of an x-ray tube useable with the system illustrated in FIG. 1.

FIG. 2 illustrates a cross-sectional view of x-ray source 12 in the form of an x-ray tube. The x-ray tube 12 includes a housing 50 (i.e., vacuum enclosure) having a radiation emission passage 52 formed therein. The housing 50 encloses a vacuum 54 and houses an anode 56 (i.e., target), a bearing assembly 58, a cathode assembly 60, and a rotor 62. A stator 61 drives rotor 62, which rotationally drives anode 56. In one embodiment, x-ray tube 12 also includes a mounting mechanism (not shown) (e.g., brackets) affixed to the housing 50 and configured to attach x-ray tube 12 to a rotatable gantry (not shown) in a computed tomography (CT) system.

Cathode assembly 60 generates and emits electrons across vacuum 54 in the form of an electron beam, which is directed at a focal track 63 on anode 56 creating a focal spot 65. To avoid overheating the anode 56 from the electrons, anode 56 is rotated at a high rate of speed about a centerline 64 at, for example, 90-250 Hz. X-rays 14 are produced when the electrons are suddenly decelerated as they are directed from the cathode assembly 60 to the anode 56 via a potential difference there between of, for example, sixty-thousand volts or more in the case of CT applications. The x-rays 14 are emitted through the radiation emission passage 52 toward a detector array, such as detector array 18 of FIG. 2.

A controller 66 (i.e., control unit) is also included as part of x-ray tube 12. The controller 66 is preferably microprocessor based, such as a computer having a central processing unit, memory (RAM and/or ROM), and associated input and output buses. The controller 66 may be a portion of source controller 30 (shown in FIG. 1) or may be a stand-alone controller as shown. As will be described in greater detail below, controller 66 provides power and timing signals to components of the x-ray tube 12 to control the operation thereof.

Figure 3:
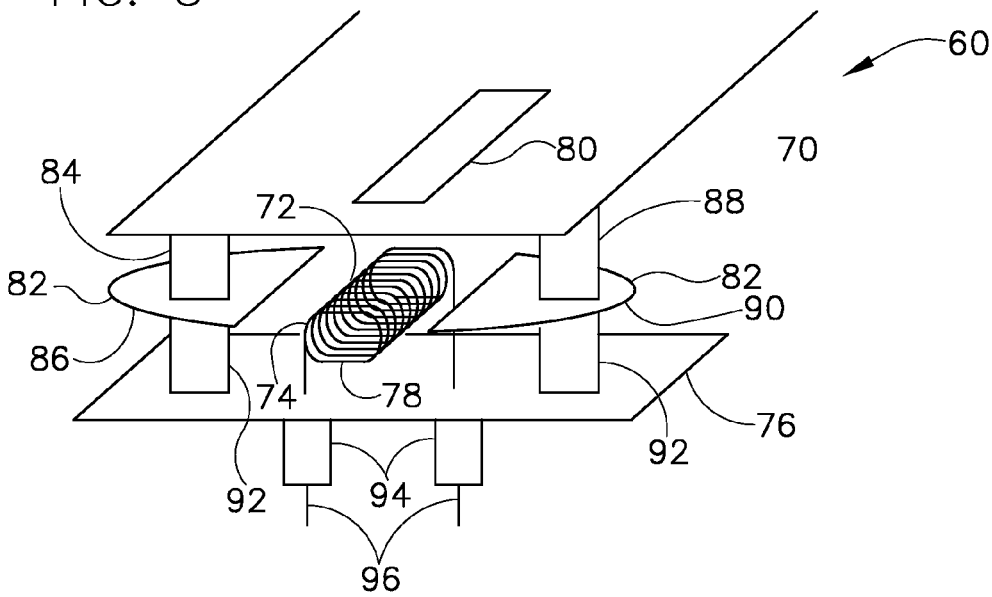
FIG. 3 is a perspective view of a cathode assembly useable with the x-ray tube of FIG. 2 according to an embodiment of the present invention.

Referring now to FIG. 3, a perspective view of the cathode assembly 60 in accordance with an embodiment of the present invention is shown. The cathode assembly 60 may include a front member 70 electrically disposed on a first side 72 of an emitter 74 and includes a backing member 76 electrically disposed on a second side 78 of the emitter 74. The front member 70 has an aperture 80 coupled therein. The emitter 74 emits an electron beam to the focal spot 65. The aperture 80 and the backing member 76 are differentially biased as to shape and focus the beam to the focal spot 65 (shown in FIG. 2). Deflection electrodes 82 (i.e., steering electrodes) are shown as an electrode pair and are electrically disposed between the backing member 76 and the front member 70. The deflection electrodes 82 adjust positioning of the focal spot on the anode 56 (shown in FIG. 2). Note that the cathode assembly 60, as shown, is symmetrically designed. Symmetrical design of the cathode assembly 60, although desired for simplicity and for electron beam shaping, is not a requirement of the present invention.

The cathode assembly 60 also includes multiple isolators separating the front member 70, the backing member 76, and the deflection electrodes 82. A first side steering electrode insulator 84 may be coupled between the front member 70 and a first side steering electrode 86 and a second side steering electrode insulator 88 may be coupled between the front member 70 and a second side steering electrode 90. The first insulator 84 and the second insulator 88 isolate the deflection electrodes 82 from the front member 70. A pair of backing insulators 92 is coupled between the deflection electrodes 82 and the backing member 76 and isolates the deflection electrodes 82 from the backing member 76. A pair of filament insulators 94 is coupled to emitter electrodes 96 to maintain the emitter 74 at a potential isolated from the backing member 76. Of course, the deflection electrodes 82 and the insulators 84, 86, 88, and 92 may be in various locations and be utilized in various combinations.

Figure 4:
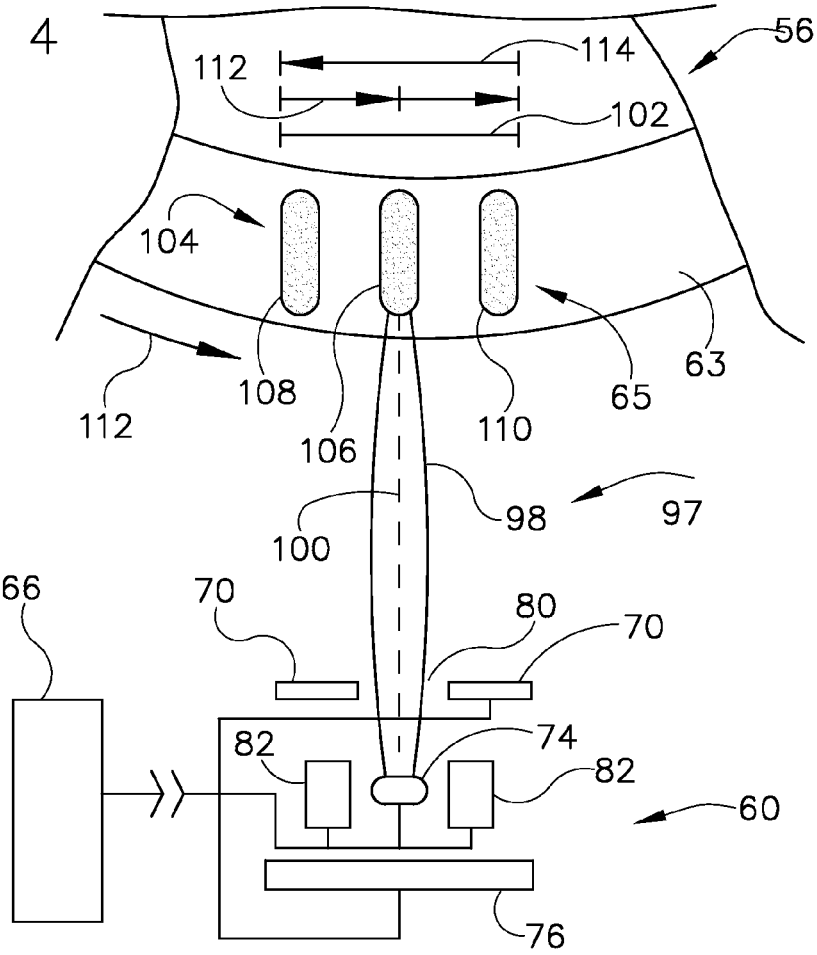
FIG. 4 is a schematic representation of a cathode assembly and an anode illustrating a multi-point focal spot pattern according to an embodiment of the present invention.

Referring now to FIG. 4, a schematic representation of the cathode assembly 60 and the anode 56 in accordance with an embodiment of the present invention is shown. The cathode assembly 60 and the anode 56 create a dipole field 97 therebetween. The emitter 74 emits an electron beam 98 through the aperture 80 in the front member 70 to the focal spot 65 on the focal track 63 across the dipole field 97. The electron beam 98 may be symmetrical to an emitter centerline 100 extending through the emitter 74 and a center of the aperture 80. During focal spot position adjustment, i.e., wobbling, the deflection electrodes 82 may be asymmetrically biased to adjust position of the focal spot 65 on the anode 56 in a direction tangent to the focal track 63. For example, the deflection electrodes 82 may be asymmetrically biased to shift the focal spot 65 to a left side or to a right side of the emitter centerline 100, as shown. The bias voltages applied to the deflection electrodes 82 are dependent on the specific application. When wobbling, the bias voltages of the deflection electrodes 82 are typically less on one side and greater on an opposite side of the electrodes as compared to the bias voltage of emitter 74. The bias voltages of the deflection electrodes 82 are greater than the bias voltage of backing member 76.

Controller 66 is configured to monitor and adjust a bias voltage applied to the various components in cathode assembly 60, including the emitter 74, deflection electrodes 82, and front and backing members 70, 76. Bias voltage applied to deflection electrodes 82 by controller 66 controls deflection of the electron beam 98 onto a desired focal spot 65 on the anode 56. A range of deflection 102 is determined by the maximum difference in bias voltage that is asymmetrically applied to the deflection electrodes 82. More precisely, the electron beam 98 and associated focal spot 65 formed on the focal track 63 will deflect from a emitter centerline 100 a maximum distance in either direction based on a maximum asymmetrical bias voltage applied to the first deflection electrode versus the second deflection electrode.

In an effort to minimize temperature along the focal track 63 and at focal spot 65, controller 66 is configured (i.e., programmed) to control deflection electrodes 82 to deflect the electron beam 98 into a multi-point focal spot pattern 104 on focal track 63 within the range of deflection 102 (i.e., focal spot range) that includes at least one focal point 106 that is bounded by a pair of boundary focal points 108, 110. The multi-point focal spot pattern 104 allows for improved cooling of the focal track 63 to occur during wobble of the electron beam 98 as compared to a standard two-point wobble. That is, because an electron beam is able to deflect continuously in a direction consistent to a direction of rotation of the anode for an entire length of the focal spot range in a standard two-point wobble pattern, greater heat is allowed to build up at the focal spot as compared to a multi-point focal spot pattern where this continuous deflection is interrupted.

Figure 5:
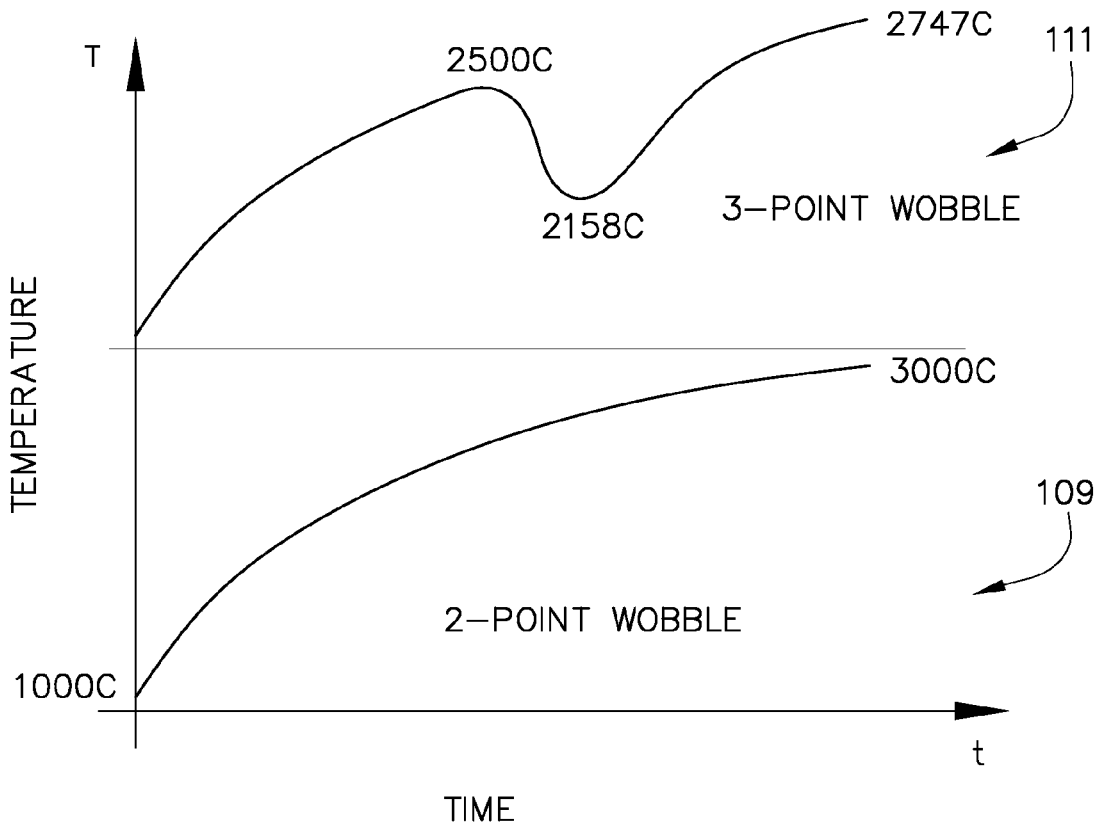
FIG. 5 is a graphical representation of a temperature profile at a focal spot for a two-point wobble scheme versus a three-point wobble scheme according to an embodiment of the present invention.

As an illustration of the improved cooling provided by a multi-point focal spot pattern, FIG. 5 shows a measurement of the temperature of the focal spot as a function of time comparing a two-point wobble scheme 109 with, for example, a three-point wobble scheme 111. For a x-ray tube operated at 100 kW, for example, two-point wobble scheme 109 would result in an exponential temperature increase that results in a maximum temperature of 3000° Celsius being present at the focal spot. For three-point wobble scheme 111, however, the temperature experienced at the focal point would be reduced to a maximum of 2747° Celsius. As shown, three-point wobble scheme 111 results in a lower maximum temperature and produces a slight reduction in focal spot temperature during deflection of the electron beam within the range of deflection. This reduction in temperature during deflection and lower maximum temperature at the focal spot results from an interruption in the beam deflection that is present in the multi-point focal spot pattern.

Referring again to FIG. 4, in one embodiment of the present invention, a three-point focal spot pattern 104 is used. A first or initial focal point 108 forms a first end of the focal spot range 102. A second or center focal point 106 is positioned away from the first focal point 108 in a direction consistent with the direction of rotation 112 of the anode 56 (i.e., in a forward direction). The second focal point 106 is located such that it forms a center point between the first focal point 108 and a third or final focal point 110 that forms a second end of the focal spot range 102. Controller 66 is thus configured to control deflection of the electron beam 98 onto each of the first, second, and third focal points 108, 106, 110 by controlling a voltage bias to deflection electrodes 82.

Controller 66 is also configured to determine the rate at which electron beam 98 travels from each defined focal point to the next and the pattern in which it does so. That is, when electron beam 98 is being deflected in a forward direction 112, controller 66 deflects the beam to second focal point 106 as an intermediate focal point before continuing to deflect over to third focal point 110. Controller 66 then controls deflection of the electron beam 98 by way of deflection electrodes 82 and causes the beam to deflect in a reverse (i.e., return) direction 114, opposite to the rotation direction 112 of the anode 56. When being deflected in the reverse direction 114, controller 66 deflects electron beam 98 directly from third focal point 110 to first focal point 108 and bypasses second focal point 106, as the impact temperature and focal spot temperature created by electron beam 98 on focal track 63 is reduced during deflection in the reverse direction 114.

Controller 66 is further configured to set a dwell time at which electron beam 98 remains stationary at a focal spot for a selected amount of time. In one embodiment, controller 66 is programmed to hold electron beam 98 at second focal point 106 when deflection is occurring in a forward direction 112. By forming a stationary focal spot at second focal point 106 for a pre-determined amount of time, a reduction in temperature along the focal track 63 is achieved as compared to if electron beam would deflect directly to third focal point 110. Besides maintaining a stationary focal spot at second focal point 106 for a pre-selected time, controller 66 can also be programmed to deflect electron beam 98 to form stationary focal spots at either first focal point 108 or third focal point 110 if desired.

In addition to controlling a wobble and deflection of electron beam 98 between first, second, and third focal points 108, 106, 110, it is also envisioned that controller 66 can vary the size of focal spot 65. By applying a variable bias voltage to front and back members 70, 76 that differs from the bias applied to emitter 74, controller 66 is able to modify dipole 97 and adjust the size of focal spot 65 formed on anode 56 by electron beam 98. In one embodiment, controller 66 is configured to increase the size of focal spot 65 during transition of the electron beam 98 between each of the first, second, and third focal points 108, 106, 110. Increasing the size of focal spot 65 during these transitions allows for a reduction in focal track 63 temperature, without affecting image quality by varying from an optimal focal spot size.

While the controller 66 and cathode assembly 60 described above function to deflect electron beam 98 by way of an electrostatic field, it is also envisioned that controller 66 and cathode assembly 60 can deflect the beam by other means. That is, controller 66 can also be configured to function with a cathode assembly that includes deflector plates therein to deflect the electron beam 98 by way of creating a magnetic field. Additionally, it is also envisioned that controller 66 can be programmed to set a plurality of focal points that is greater then the three-point focal spot pattern set forth above. A four or five point focal spot pattern could also be implemented, with controller 66 configured to create stationary points at a desired number of points within these focal patterns, as desired by an operator.

A technical contribution for the disclosed method and apparatus is that it provides for a controller implemented method and apparatus for operating an electromagnetic energy source and creating a wobble scheme that includes a multi-point focal pattern for a focal spot.

Therefore, according to one embodiment of the present invention, an x-ray tube includes, an anode comprising a focal track and a cathode assembly configured to emit an electron beam toward a focal spot on the focal track. The x-ray tube also includes a controller configured to wobble the electron beam among a plurality of focal points in a direction tangent to the focal track, the plurality of focal points comprising at least one focal point bounded by a pair of boundary focal points. The controller is further configured to delay wobble of the electron beam away from the at least one focal point for a pre-determined amount of time.

According to another embodiment of the present invention, a method for operating an electromagnetic energy source includes the step of emitting an electron beam along a beam path from a cathode and onto a focal spot on a target to cause X-rays to be emitted from the target. The method also includes the step of asymmetrically biasing the electron beam to shift the focal spot on the target within a focal spot range, the step of asymmetrical biasing further including biasing the electron beam onto a first focal point, wherein the first focal point is positioned at a first end of the focal spot range. The step of asymmetrically biasing further includes biasing the electron beam from the first focal point onto a second focal point, wherein the second focal point is positioned between the first focal point and a third focal point positioned at a second end of the focal spot range and wherein the electron beam remains stationary at the second focal point for a specified dwell time. The step of asymmetrically biasing still further includes biasing the electron beam from the second focal point onto the third focal point.

According to yet another embodiment of the present invention, an x-ray source includes a vacuum enclosure, a rotatable anode disposed within the vacuum enclosure, and a cathode assembly disposed within the vacuum enclosure that emits an electron beam onto a focal spot of the rotatable anode, the cathode assembly comprising a steering electrode configured to asymmetrically bias the electron beam. The x-ray source also includes a control unit configured to control the steering electrode to deflect the electron beam onto the rotatable anode in a multi-point focal spot pattern within a range of deflection, wherein the multi-point focal spot pattern includes a stationary focal point positioned between ends of the range of deflection and wherein the control unit is further configured to control the steering electrode to maintain deflection of the electron beam at the stationary focal point for a desired time.

The present invention has been described in terms of the preferred embodiment, and it is recognized that equivalents, alternatives, and modifications, aside from those expressly stated, are possible and within the scope of the appending claims.

What is claimed is:

1. An x-ray tube comprising:

an anode comprising a focal track;

a cathode assembly configured to emit an electron beam toward a focal spot on the focal track;

a controller configured to wobble the electron beam among a plurality of focal points in a direction tangent to the focal track, the plurality of focal points comprising at least one focal point bounded by a pair of boundary focal points; and wherein the controller is further configured to delay wobble of the electron beam away from the at least one focal point for a pre-determined amount of time.

2. The x-ray tube of claim 1 wherein the pair of boundary focal points further comprises an initial focal point and a final focal point, and wherein the at least one focal point comprises a center focal point located at a point on the focal track centered between the initial focal point and the final focal point.

3. The x-ray tube of claim 2 wherein the controller is further configured to wobble the electron beam to the center focal point for the pre-determined amount of time only when a direction of the deflection is the same as a direction of rotation of the anode.

4. The x-ray tube of claim 2 wherein the controller is further configured to wobble the electron beam from the final focal point directly to the initial focal point in a direction opposite to the direction of rotation of the anode without deflecting the electron beam to the center focal point.

5. The x-ray tube of claim 2 wherein the controller is further configured to produce a wobble signal to deflect the electron beam to the initial focal point and the final focal point for a pre-determined amount of time.

6. The x-ray tube of claim 1 wherein the cathode assembly further comprises:

an emitter element that emits an electron beam; and a pair of deflection electrodes electrically disposed between the emitter element and the anode to adjust positioning of the focal spot on the focal track when at least one of the deflection electrodes is biased.

7. The x-ray tube of claim 6 wherein the controller is further configured to control a bias voltage sent to the pair of deflection electrodes to cause the electron beam to be deflected.

8. The x-ray tube of claim 6 wherein the cathode assembly further comprises a front member and a backing member differentially biased relative to the emitter element to contribute to formation of the electron beam.

9. The x-ray tube of claim 8 wherein the controller is further configured to control a bias voltage sent to the front member and the backing member to control a size of the focal spot on the focal track.

10. The x-ray tube of claim 9 wherein the size of the focal spot is increased during a transition of the electron beam from the initial focal point to the center focal point, from the center focal point to the final focal point, and from the final focal point to the initial focal point.

11. A method for operating an electromagnetic energy source comprising the steps of:

emitting an electron beam along a beam path from a cathode and onto a focal spot on a target to cause X-rays to be emitted from the target;

asymmetrically biasing the electron beam to shift the focal spot on the target within a focal spot range; and wherein the asymmetrical biasing further includes:

biasing the electron beam onto a first focal point, the first focal point positioned at a first end of the focal spot range;

biasing the electron beam from the first focal point onto a second focal point, the second focal point positioned between the first focal point and a third focal point positioned at a second end of the focal spot range;

biasing the electron beam from the second focal point onto the third focal point; and wherein the electron beam remains stationary at the second focal point for a specified dwell time.

12. The method of claim 11 wherein the second focal point is positioned at a center point of the focal spot range.

13. The method of claim 11 wherein the steps of biasing the electron beam from the first focal point onto the second focal point and biasing the electron beam from the second focal point onto the third focal point further comprise biasing the electron beam in a direction matching that of a direction of rotation of the target.

14. The method of claim 11 further comprising the step of biasing the electron beam from the third focal point back onto the first focal point in a direction opposite to the direction of rotation of the target.

15. The method of claim 11 further comprising the steps of:

generating a dipole field between the cathode and the target; and modifying the dipole field to alter a shape and size of the focal spot on the target.

16. The method of claim 15 wherein the step of modifying further comprises modifying the dipole field during a transition of the electron beam from at least one of the first focal point to the second focal point, the second focal point to the third focal point, and the third focal point to the first focal point.

17. The method of claim 11 wherein the step of asymmetrically biasing the electron beam further comprises individually controlling a bias voltage to at least one pair of deflection electrodes configured to deflect the electron beam.

18. An x-ray source comprising:

a vacuum enclosure;

a rotatable anode disposed within the vacuum enclosure;

a cathode assembly disposed within the vacuum enclosure that emits an electron beam onto a focal spot of the rotatable anode, the cathode assembly comprising a steering electrode configured to asymmetrically bias the electron beam; and a control unit configured to control the steering electrode to deflect the electron beam onto the rotatable anode in a multi-point focal spot pattern within a range of deflection, wherein the multi-point focal spot pattern includes a stationary focal point positioned between ends of the range of deflection, and wherein the control unit is further configured to control the steering electrode to maintain deflection of the electron beam at the stationary focal point for a desired time.

19. The x-ray source of claim 18 wherein the control unit is further configured to:

deflect the electron beam in a forward direction from a starting focal point in a three-point focal spot pattern and onto the stationary focal point;

hold the electron beam at the stationary focal point for a selected amount of time;

deflect the electron beam in a forward direction from the stationary focal point and onto an ending focal point in the three-point focal spot pattern; and wherein the starting focal point and the ending focal point define the ends of the range of deflection.

20. The x-ray source of claim 19 wherein the control unit is further configured to deflect the electron beam in a reverse direction in a reset travel, the reset travel deflecting the electron beam from the ending focal point back to the starting focal point while bypassing the stationary focal point.

21. The x-ray source of claim 18 wherein the cathode assembly further comprises a front member and a backing member to contribute to formation of the electron beam.

22. The x-ray source of claim 21 wherein the control unit is further configured to control a bias voltage sent to the front member and backing member to control a size of the focal spot on the rotating anode, and wherein the size of the focal spot is increased during a transition of the electron beam between focal points in the multi-point focal spot pattern.

23. The x-ray source of claim 18 further comprising a mounting mechanism affixed to the vacuum enclosure and configured to attach the x-ray source to a rotatable gantry in a computed tomography (CT) system.

* * * * *